United States Patent [19]

Dowd

[11] Patent Number: 4,574,725

[45] Date of Patent: Mar. 11, 1986

[54] COLLAPSIBLE BOAT

[76] Inventor: Dennis Dowd, R.R. 2, Box 218A, Sioux City, Iowa 50312

[21] Appl. No.: 626,940

[22] Filed: Jul. 2, 1984

[51] Int. Cl.[4] ..... B63B 7/04

[52] U.S. Cl. ..... 114/352

[58] Field of Search ..... 114/352, 353, 77 R, 114/77 A

[56] References Cited

U.S. PATENT DOCUMENTS

| | | | |
|---|---|---|---|
| 1,575,982 | 3/1926 | Ferris | 114/352 |
| 1,916,093 | 6/1933 | Cormier | 114/352 |
| 2,441,999 | 6/1944 | Fulke | 114/352 |
| 2,443,768 | 6/1948 | House | 114/352 |
| 3,266,067 | 8/1966 | Windle | 114/352 |
| 3,400,414 | 9/1968 | Windle | 114/352 |
| 3,996,634 | 12/1976 | Grind | 114/352 |
| 4,478,167 | 10/1984 | Hart | 114/352 |
| 4,522,145 | 6/1985 | Stone | 114/352 |

*Primary Examiner*—Trygve M. Blix
*Assistant Examiner*—Stephen P. Avila
*Attorney, Agent, or Firm*—Robert W. Carlson

[57] ABSTRACT

This invention relates to a collapsible boat wherein the sections are formed in a manner that they may be stacked to facilitate transporting the boat. Also the structure of the sections are such that the boat may be easily and readily assembled and is waterproof when fully assembled.

5 Claims, 7 Drawing Figures

Fig. 4
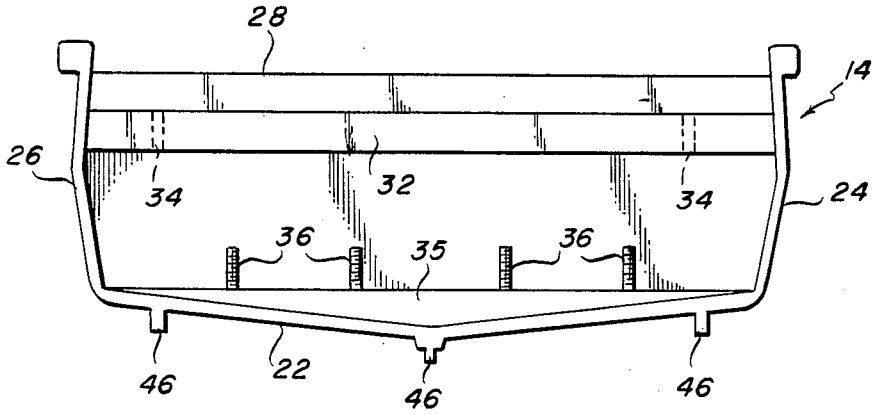
Fig. 5
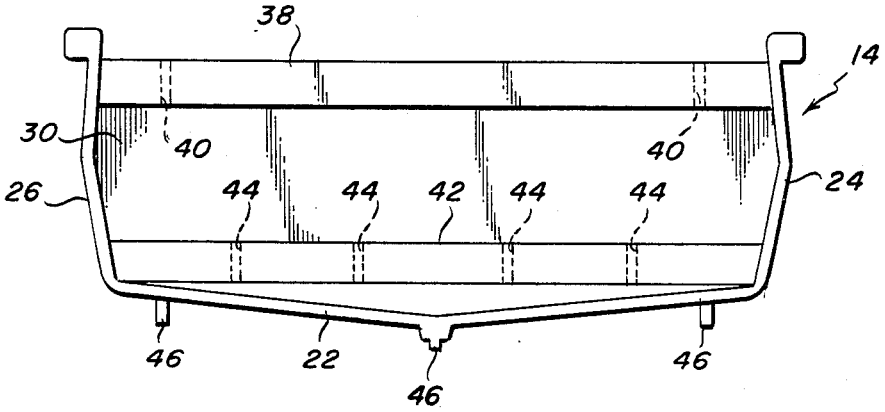
Fig. 6
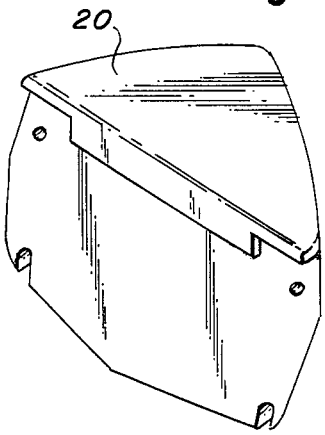
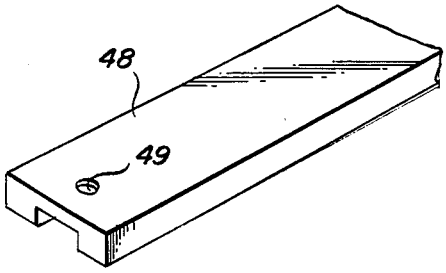
Fig. 7

COLLAPSIBLE BOAT

BACKGROUND OF INVENTION

There have been numerous attempts to provide a collapsible boat made of sections which may be stacked when the boat is to be transported. Such boats are very desirable to hunters and fishermen.

One of the attractive features of collapsible boats is that it may be assembled quickly and easily with a minimum numbers of tools.

Some of the prior art boats are Wilkes et al U.S. Pat. No. 3,996,635 which discloses a collapsible boat comprising a plurality of sections capable of being nested one within the other for transporation.

A further example of such a boat is shown by Cormier, U.S. Pat. No. 1,916,093.

The prior art closest to applicant's invention is considered to be the boat construction disclosed by Windle U.S. Pat. No. 3,266,067. Applicant's invention provides a vast improvement over the Windle boat construction as will become apparent from a detailed description of applicant's invention which follows:

THE DRAWINGS

FIG. 4 is an end view of one section of the boat;

FIG. 5 is a view of the opposite end of the section shown in FIG. 4;

FIG. 6 is a partial perspective view of the bow section of the boat; and

FIG. 7 is a partial perspective view of a seat.

DESCRIPTION OF THE INVENTION

The boat 10 is comprised of a plurality of mid sections 12, 14, 16, a stern section 18 and a bow section 20.

Figure 1:
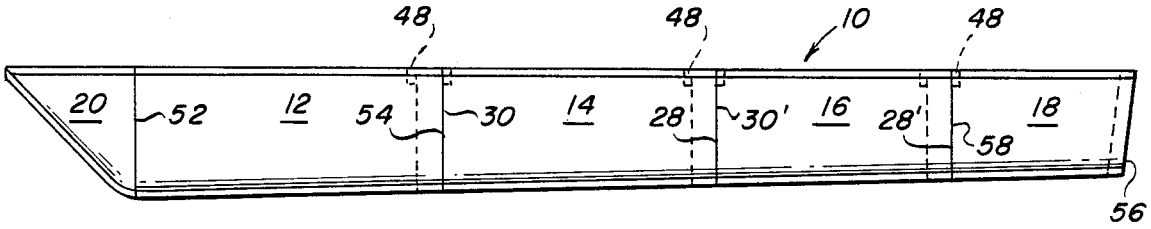
FIG. 1 is a sideview of the boat; fully assembled.
Figure 2:
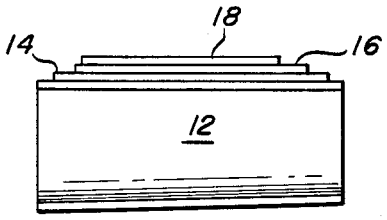
FIG. 2 is a sideview of the boat sections in stacked relation.

The sections 14 and 16 are identical in structure but vary in size so that they may be stacked in the manner illustrated in FIG. 2. It will be sufficient to describe in detail only one section.

The section 14 is a molded integral unit of plastic having a bottom 22, sidewalls 24 and 26 and end walls 28 and 30.

Figure 3:
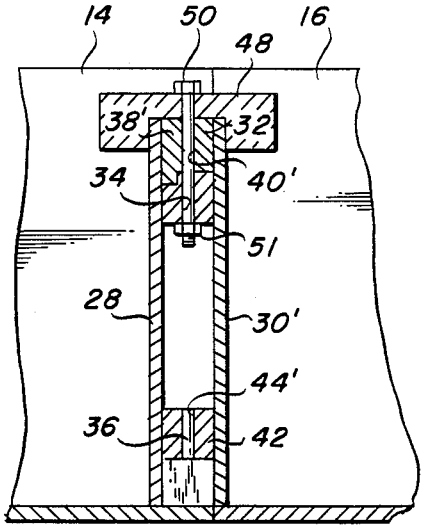
FIG. 3 is a partial sectional view showing the connection between sections of the boat.

The end wall 28 is positioned inwardly of the end of the bottom 22 as best illustrated in FIG. 3 and is provided adjacent to the top edge thereof. The bar 32 is L-shaped in cross section and is provided with a plurality of bores 34 extending vertically therethrough.

A bar 35 extending laterally along the bottom 22 is provided with a plurality of pins 36 which extend upwardly therefrom.

The end wall 30 is also provided with a horizontal bar 38 extending from the external side thereof and the top of the bar is flush with the top edge of the end wall 30. The bar 38 is L-shaped in cross section and is provided with a plurality of bores 40. Another horizontal bar 42 extends from the external side of the wall 30 adjacent the bottom 22. The bar 42 is rectangular in cross section and is provided with a plurality of bores 44 extending vertically therethrough.

A plurality of ribs 46 may be provided which extend the full length of the bottom 22 to add stability to the movement of the boat through the water.

The structure of the section 16 is identical to that of section 14 and need not be illustrated. The various elements of section 16 will be referred by by prime numbers.

When the sections 14 and 16 are to be joined together, the end wall 30' of the section 16 is brought into position with the end wall 28 of section 14 with the bar 42 overlying the pins 36. The section 16 is then lowered so the pins 36 extend into the bores 44'. The bar 38' is now resting on the bar 32 with the bores 34 overlying the bores 40'.

Seats 48 are provided in the form of a U-shaped channel member having an aperture 50 adjacent each end thereof. A pair of bolts are inserted through the inboard pairs of bores 34 and 40' to secure the sections together by nuts, not illustrated. A seat 48 is placed over the tops of the walls 28 and 30' with the apertures 50 overlying the outboard pairs of bores 34 and 40'. Bolts extend into the bores 34 and 40' through the apertures 50 to secure the seat 48 in place.

The section 12 is provided with a smooth end wall 52 and an end wall 54 identical in structure to that of end wall 28 of section 14. Similarly, the section 18 is provided with a smooth end wall 56 and an end wall 58 identical in structure to that of end wall 30 of section 14.

The section 12 is secured to section 14 and section 18 is secured to section 16 in the manner described above.

A bow section 20 is provided which is formed in one piece and preferably of bouyant material and is secured to section 12 by bolts.

From the foregoing, it will be readily apparent that very few tools are necessary to assemble and disassemble the boat. When disassembled, the sections are stacked to form a compact package which is convenient to transport. When assembled, the boat is sturdy and watertight. No seals or the like are necessary.

The various sections may be formed in an economical manner so that an inexpensive and practical collapsible boat is provided.

An example of the construction of the boat results in a model which is 12'6" long when assembled. The sections, when stacked for a package of 42"×42"×24". Each section weighs about 35 pounds.

What is claimed:

1. In a collapsible boat comprising a bow section, a plurality of sections and a stern section, said sections adapted to be stacked in a nested assembly for transportation, means on each section for securing said sections in end-to-end relation to form a rigid, leak proof boat the improvement comprising a plurality of sections, each of said sections having side walls and end walls, each of said plurality of sections having a first L-shaped bar extending laterally on one end adjacent top thereof from side wall to side wall, a first rectangular bar extending laterally of said one end adjacent the bottom thereof, a plurality of bores extending vertically through said first L-shaped bar, a plurality of pins extending upwardly from said first rectangular bar, the other end of said section having a second L-shaped bar extending laterally and adjacent the top thereof, a second rectangular bar extending laterally adjacent the bottom of said section, a plurality of vertically extending bores through said second L-shaped bar and said second rectangularly shaped bar, said plurality of sections being assembled in such a manner that said first L-shaped bar on one section interlocks with said second L-shaped bar on an adjacent section and said first rectangular bar having pins thereon of an adjacent section with the pins extending into said second rectangular bar bores so that the sidewalls and bottom of one section is tightly engaged with the sidewalls and the bottom of an adjacent section.

2. A collapsible boat as set forth in claim 1 including a plurality of U-shaped members adapted to fit over the end of adjacent sections to form seats.

3. A collapsible boat as set forth in claim 1 wherein said bow section is formed of a hollow one-piece V-shaped section having a plurality of bores extending through a wall thereof for attachment to a selected one of said plurality of sections.

4. A collapsible boat as set forth in claim 1 wherein said stern section has one end wall being solid throughout.

5. A collapsible boat as set forth in claim 1 including a plurality of screws for securing said sections together.

* * * * *